US011313368B2

(12) United States Patent
Shaw

(10) Patent No.: US 11,313,368 B2
(45) Date of Patent: Apr. 26, 2022

(54) MULTISTAGE PUMP ASSEMBLY WITH AT LEAST ONE CO-USED SHAFT

(71) Applicant: Raymond Zhou Shaw, Salisbury, MD (US)

(72) Inventor: Raymond Zhou Shaw, Salisbury, MD (US)

(73) Assignees: ELIVAC COMPANY, LTD., Qingpu District (CN); Raymond Zhou Shaw, Shanghai (CN); ELIVAC INC., Salisbury, MD (US)

( * ) Notice: Subject to any disclaimer, the term of this patent is extended or adjusted under 35 U.S.C. 154(b) by 140 days.

(21) Appl. No.: 16/810,819

(22) Filed: Mar. 5, 2020

(65) Prior Publication Data

US 2021/0277899 A1 Sep. 9, 2021

(51) Int. Cl.

| | |
|---|---|
| ***F04C 23/00*** | (2006.01) |
| ***F04C 25/02*** | (2006.01) |
| ***F04C 29/00*** | (2006.01) |
| ***F04C 18/12*** | (2006.01) |

(52) U.S. Cl.

CPC ..... *F04C 23/001* (2013.01); *F04C 25/02* (2013.01); *F04C 2240/60* (2013.01); *F04C 2240/70* (2013.01); *F04C 2240/806* (2013.01)

(58) Field of Classification Search

CPC .... F04C 23/001; F04C 25/02; F04C 29/0085; F04C 18/126

USPC ..... 418/201.1, 215, 216, 209

See application file for complete search history.

(56) References Cited

U.S. PATENT DOCUMENTS

| | | | | |
|---|---|---|---|---|
| 4,934,908 | A * | 6/1990 | Turrell | F04C 23/001 418/3 |
| 6,375,431 | B1 * | 4/2002 | Ando | F04C 23/001 417/44.1 |
| 9,541,088 | B2 * | 1/2017 | Kawamura | F01C 21/007 |
| 2004/0081565 | A1 * | 4/2004 | Kuramoto | F04C 23/001 417/360 |
| 2013/0280062 | A1 * | 10/2013 | Suzuki | F04C 11/001 415/213.1 |
| 2018/0085799 | A1 * | 3/2018 | Miyazaki | F04C 23/005 |
| 2018/0149156 | A1 * | 5/2018 | Shaw | F04C 23/001 |

* cited by examiner

*Primary Examiner* — Deming Wan

(57) ABSTRACT

A multistage pump assembly with at least one co-used shaft comprises a first pump set including at least two vacuum chambers. Each vacuum chamber of the first pump set is installed with at least one rotor and a first driving shaft, the rotor is installed to the first driving shaft in the same vacuum chamber of the first pump set. The first driving shafts in the first pump set are co-shafted, that is, rotors in the at least two vacuum chambers of the first pump set are installed at the same first driving shaft. A second pump set includes at least one vacuum chamber which includes at least one rotor and a second driving shaft. An outlet of the second pump set is connected to an inlet of the first pump set through an air tube.

10 Claims, 4 Drawing Sheets

MULTISTAGE PUMP ASSEMBLY WITH AT LEAST ONE CO-USED SHAFT

FIELD OF THE INVENTION

The present invention is related to a pump assembly, and in particular to a multistage pump assembly with at least one co-used shaft.

BACKGROUND OF THE INVENTION

Generally, the root pumps will generate higher vacuum, but the output pressure thereof cannot achieve to a pressure which can cause the air to vent out directly. Therefore, other vacuum pumps are necessary to be preinstalled to cause air to be drained out.

Furthermore, air in air cooling root pump can be drained out directly, however, in this kind of pump, the drained air must be returned and cooled, and then returned to the vacuum chamber so that the efficiency is low, and power consumption is high, while the noise is large. The highest working vacuum is only about 20000 Pars.

From the viewpoint of environment protection and power saving, dry pump is the trend in future, but this kind of pumps have the problem of generating a large amount of undesired oil and water. This induces other problems. To improve this problem, inventor of the present invention provides a vacuum pump set with multistage vacuum chambers, in that all the vacuum pumps uses the same shaft. Each vacuum chamber is installed with a pair of rotors, but in this prior art structure, all the vacuum chambers are co-shafted. Although this prior art structure may resolve the problem of environmental protection, but heat expansion of the shaft will induce many serious mechanic problem to be solved.

The present invention further provides a novel structure which can improve the defects in the prior art.

SUMMARY OF THE INVENTION

Accordingly, for improving above mentioned defects in the prior art, the object of the present invention is to provide a multistage pump assembly with at least one co-used shaft. As comparing with the current used root pumps, currently, all the root pumps are serially connected with a co-shaft. The compression ratio, air flow and positions of the vacuum pumps are fixed and are unadjusted. Furthermore in low vacuum, this kind of pumps can not have a large compression ratio for prevent the pump to be deadly locked, while in high vacuum, the compression ratio will be reduced. Therefore, this kind of pump set has finite working range. However, in the present invention, the pumps can be arranged as desired so that the compression ratio and vacuum are adjustable to desired ones and thus safety operation and efficiency are well controlled so that heat increments are uniformly distributed in various stages of the pumps. Furthermore, as comparing with other kinds of pumps, the present invention will not cause air to be accumulated in the former pump so as to interfere the operation of the pump, while the prior art serial connected pumps have such defect.

To achieve above object, the present invention provides a multistage pump assembly with at least one co-used shaft comprising a first pump set including at least two vacuum chambers, each vacuum chamber of the first pump set being installed with at least one rotor and a first driving shaft, the rotor being installed to the first driving shaft in the same vacuum chamber of the first pump set; the first driving shafts in the first pump set are co-shafted, that is, rotors in the at least two vacuum chambers of the first pump set are installed at the same first driving shaft; a second pump set including at least one vacuum chamber which includes at least one rotor and a second driving shaft; and wherein an outlet of the second pump set is connected to an inlet of the first pump set through an air tube.

DETAILED DESCRIPTION OF THE INVENTION

Figure 1:
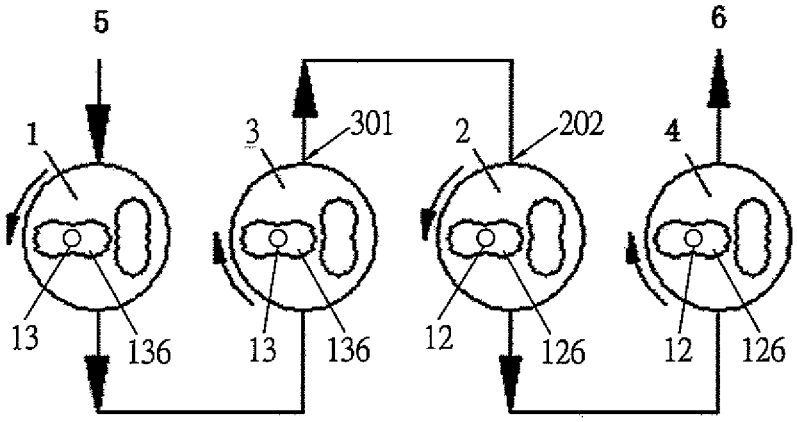
FIG. 1 shows the operation principle of the present invention.

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

The structure of the present invention includes the following elements:

A first pump set 100 including at least two vacuum chambers 1, 2, a first vacuum chamber 1 and a second vacuum chamber 2, each vacuum chamber 1,2 of the first pump set is installed with at least one rotor 136 (see FIG. 1) and a driving shaft 13, the rotor 136 being installed to the driving shaft 13 in the same vacuum chamber of the first pump set 100; the driving shafts 13 in the first pump set 100 are co-shafted, that is, rotors 136 in the at least two vacuum chambers 1, 2 of the first pump set 100 are installed at the same driving shaft 13.

A second pump set 200 including at least one vacuum chamber 3 which includes at least one rotor 126 and a driving shaft 12. In the embodiment shown in FIG. 5, the second pump set 200 includes a third vacuum chamber 3 and a fourth vacuum chamber 4. Each of the third vacuum chamber 3 and the fourth vacuum chamber 4 has its own at least one rotor 126 and a driving shaft 12.

An outlet 301 of the second pump set 200 is connected to an inlet 202 of the first pump set 100 through an air tube 500.

Figure 5:
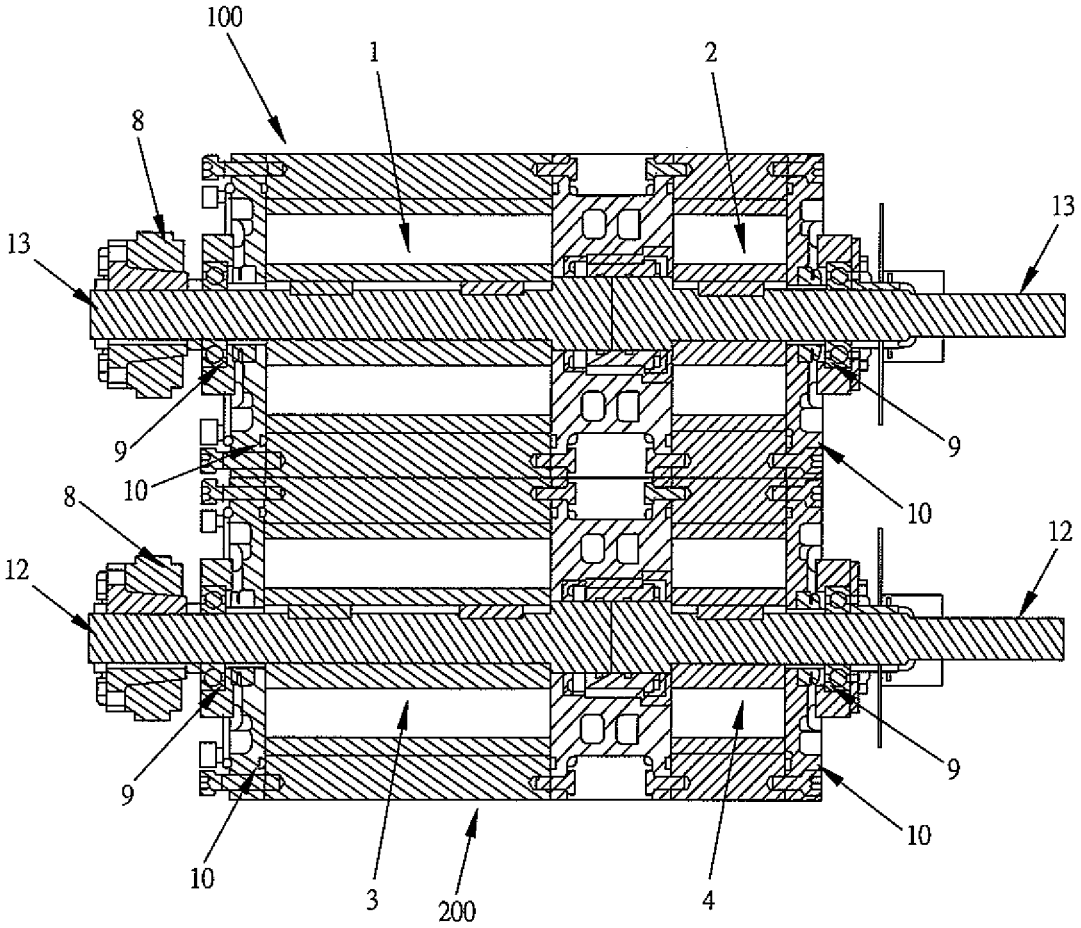
FIG. 5 is a cross section view of FIG. 4.

In this embodiment, as shown in FIG. 5, the second pump set 200 includes two vacuum chambers, a third vacuum chamber 3, and a fourth vacuum chamber 4, each vacuum chamber 3, 4, of the second pump set 200 is installed with at least one rotor 126 and a driving shaft 12, the rotor 126 of the second pump set 200 being installed to the driving shaft 12 in the same vacuum chamber of the second pump set 200; the shafts 12 in the second pump set 200 are co-shafted, that is, rotors 126 in the at least two vacuum chambers 3, 4 of the second pump set 200 are installed at the same driving shaft 12;

In one example, the compression ratios of vacuum chambers are 20, 6, 3, 3 sequentially. For example, if the input pressure has a pressure of 1 mbar, the output pressures of the four vacuum chambers are sequentially, 20 mbar, 120 mbar, 360 mbar, and 1080 mabr. However, the specifications about the compression ratios are not confined in the present invention.

Figure 4:
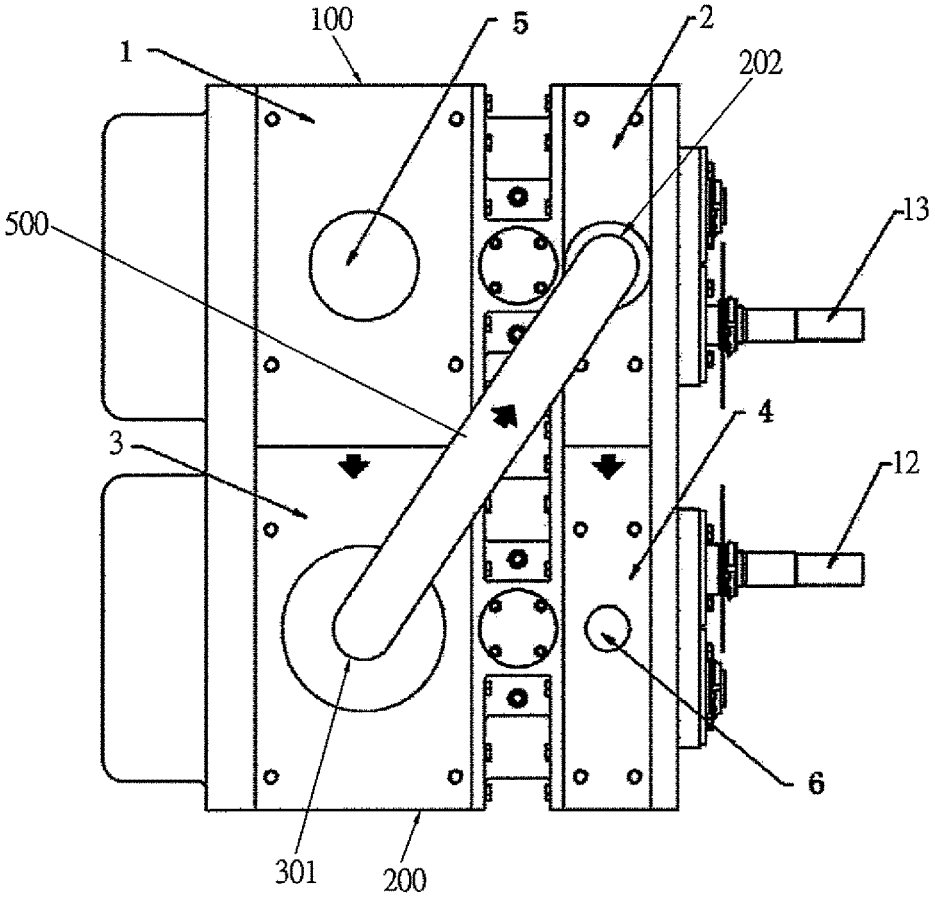
FIG. 4 is a structural schematic view showing the arrangement of co-shafted vacuum chambers.

Referring to FIG. 4, it illustrates a four vacuum chamber system with the first pump set 100 and the second pump set 200 and all related components as described above. Referring to FIG. 1, it illustrates that the air is input from the vacuum pump suction 5 to a first vacuum pump 1 and then to the third vacuum chamber 3, second vacuum chamber 2, and fourth vacuum chamber 4 sequentially. Finally, air is drained out from the vacuum pump outlet 6. Where element 7 is a first connector for sealing the two shafts 13, 8 is a gear, 9 is a bearing.

In this embodiment, as shown in FIG. 5, the first vacuum chamber 1 and the second vacuum chamber 2 includes the same driving shaft 13 which is connected to a driving motor (not shown). The third vacuum chamber 3 and the fourth vacuum chamber 4 have the same driving shaft 12 which is connected to a driving motor (not shown). Rotors 136 of the first vacuum chamber 1 and the second vacuum chamber 2 have identical rotation direction; and rotors 126 of the third vacuum chamber 3 and the fourth vacuum chamber 4 have identical rotation direction but which is opposite to the rotation direction of the rotors of the first vacuum chamber 1 and the second vacuum chamber 2.

In the present invention, not the driving shafts in all the vacuum chambers are coaxial. This is not identical to the arrangement of current multi-stage root pumps, claw type vacuum pump, screwrod vacuum pump.

Figure 3:
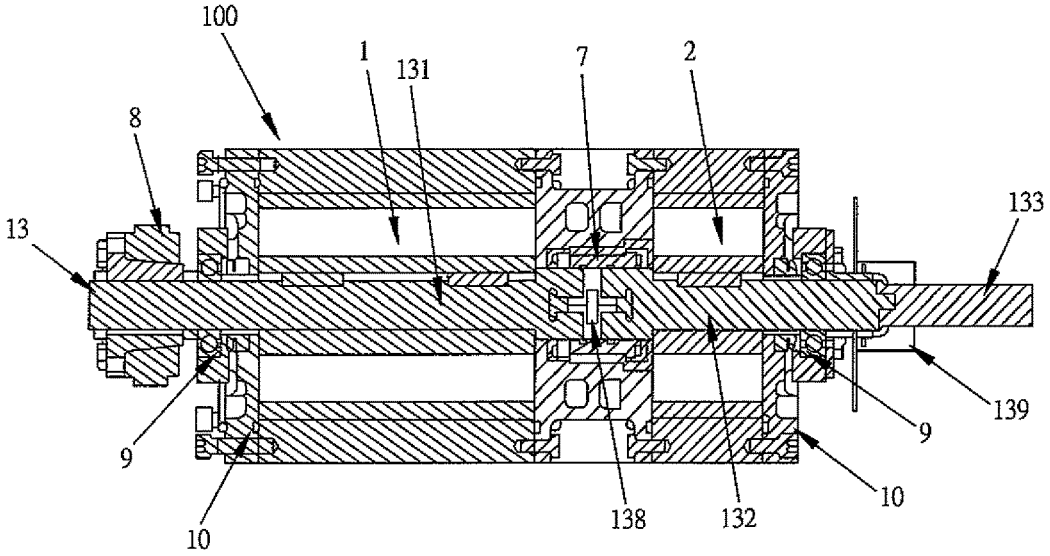
FIG. 3 shows another embodiment of FIG. 2.

Referring to FIG. 3, another embodiment of the present invention is illustrated. The first vacuum chamber 1 and the second vacuum chamber 2 are driven by a same driving shaft 13. The driving shaft 13 is formed by at least one two separated driving shafts. In this embodiment, there are three separated driving shafts 131, 132, 133 which are connected sequentially one by one. The first separated driving shaft 131 is connected to the second separated driving shaft 132 through a first connector 138 and the second separated driving shaft 132 is connected to the third separated driving shaft 133 through a second connector 139. The first separated driving shaft 131 is within the first vacuum chamber 1 and the second separated driving shaft 132 is within the second vacuum chamber 2. The third separated driving shaft 133 is out of the second vacuum chamber 2. The third separated driving shaft 133 is connected to a spindle of a driving motor (not shown).

In the present invention, there are two driving motors (not shown) which have different rotation speeds so that the rotors in the first and second vacuum chambers 1, 2 are different from that in the third and fourth vacuum chambers 3, 4 and have opposite rotation directions. Therefore, air can flow through the four vacuum chambers 1,2,3,4 with a shortest path and no dead angle. The rotations of rotors serve to adjust the suction of air from an input of the first vacuum chamber 1.

In current multistage root vacuum chambers, all the blades are installed on the same shaft. The air out of one vacuum chamber must flow to another side of the air outlet and then flow into the air inlet of a following vacuum chamber. However, in the present invention, there are at least two driving shafts so that rotors are not arranged on the same shaft. As a result, the air path may be arranged as desired to a shortest airpath so as dust in the air can be flew out smoothly.

Furthermore the prior art multistage root vacuum chambers have finite stages and thus the size is confined otherwise the shaft will be too long so that mechanical steadiness is reduced. However, the present invention need not concern about this point.

Figure 2:
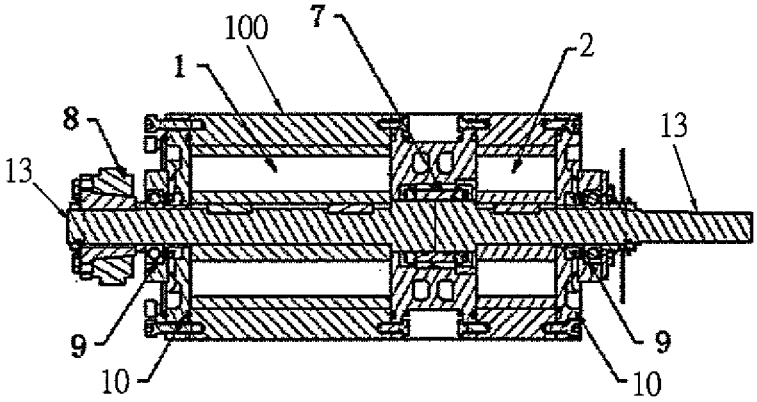
FIG. 2 is a structural schematic view about an embodiment of the present invention.
Figure 6:
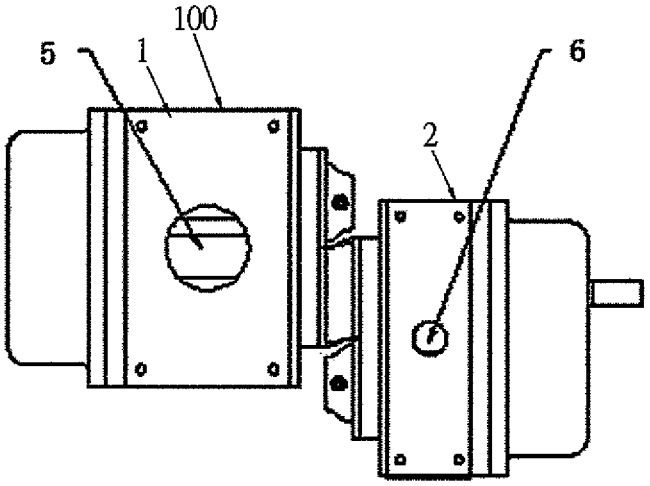
FIG. 6 is a schematic view about a further embodiment of the present invention.
Figure 7:
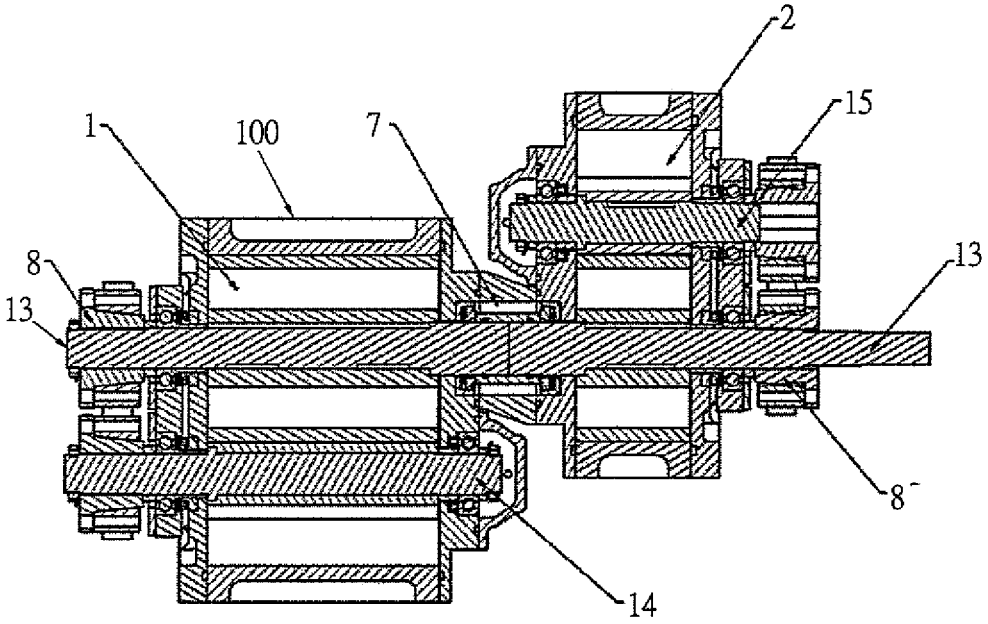
FIG. 7 is a cross section view of FIG. 6.

FIGS. 6 and 7 show another embodiment of the present invention. The embodiment is identical to the first embodiment shown in FIGS. 2 and 3, only other driven shafts 14 and 15 are added. Therefore, for the elements identical to those shown in FIGS. 2 and 3 are illustrated by the same numerals and the details will not be further described. Only those differences are described herein.

Figure 8:
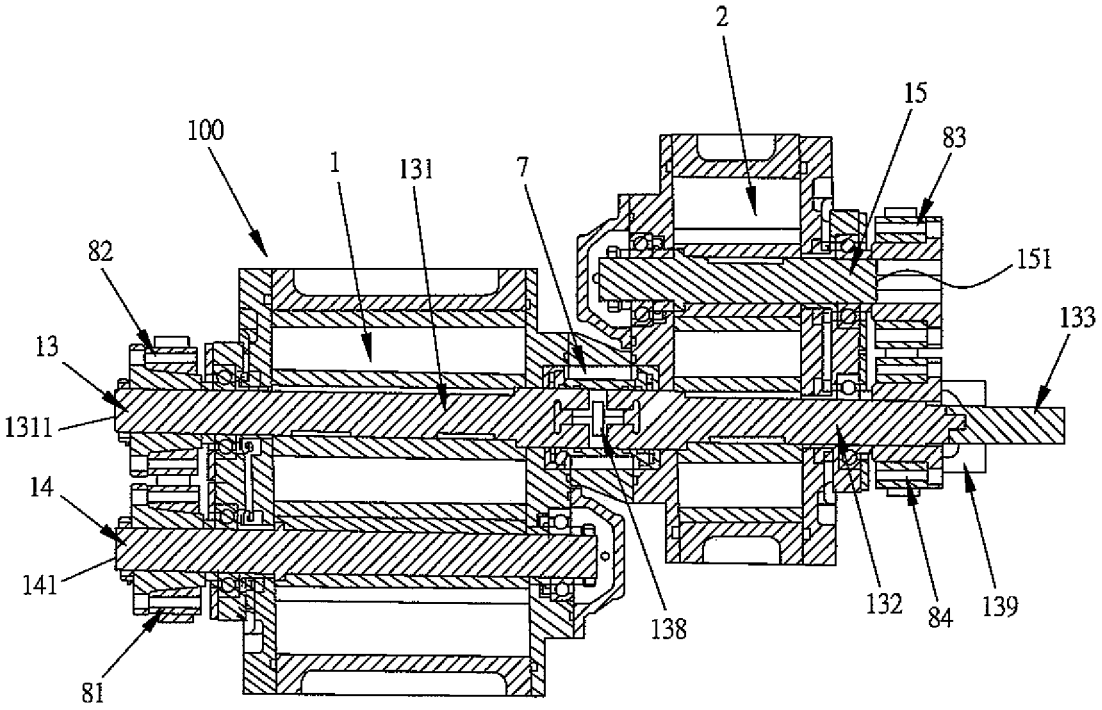
FIG. 8 is another embodiment of FIG. 7.

In this embodiment, as shown in FIG. 8, the first vacuum chamber 1 includes a first driven shaft 14 which is connected to a first gear 81 at an outer side of the first vacuum chamber 1 and the first separated driving shaft 131 is connected with a second gear 82. The first gear 81 is engaged with the second gear 82.

Similarly, as shown in FIG. 8, the second vacuum chamber 2 includes a second driven shaft 15 which is connected to a third gear 83. The second separated driving shaft 132 is connected with a fourth gear 84. The third gear 82 is engaged with the fourth gear 84. The first separated driving shaft 131 and the second separated driving shaft 132 are connected through the first connector 7, but are separated with a predetermined distance so as to delete the expansion from heating, and thus to protect the blades and shafts 13, 131, 132 and 133.

The present invention, each of the first and second pump set 100, 200 may be various kinds of vacuum pump set, including multistage root vacuum pump set, claw form vacuum pump set, screw rod form vacuum pump set. Air sucked is compressed gradually to achieve a pressure greater the atmosphere and then it is drained out.

As comparing with the current used root pumps, currently, all the root pumps are serially connected with a co-shaft. The compression ratio, air flow and positions of the vacuum pumps are fixed and are unadjusted. Furthermore in low vacuum, this kind of pumps can not have a large compression ratio for prevent the pump to be deadly locked, while in high vacuum, the compression ratio will be reduced. Therefore, this kind of pump set has finite working range. However, in the present invention, the pumps can be arranged as desired so that the compression ratio and vacuum are adjustable to desired ones and thus safety operation and efficiency are well controlled so that heat increments are uniformly distributed in various stages of the pumps.

Furthermore, as comparing with other kinds of pumps, the present invention will not cause air to be accumulated in the former pump so as to interfere the operation of the pump, while the prior art serial connected pumps have such defect.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A multistage pump assembly with at least one co-used shaft comprising:

a first pump set (100) including at least two vacuum chambers, each of the vacuum chamber of the first pump set (100) being installed with at least one rotor (136) and a first driving shaft (13), the at least one rotor (136) of each of the vacuum chambers of the first pump set (1001 being installed to the respective first driving shaft (13) in the same vacuum chamber of the first pump set (100); the first driving shafts in all the vacuum chamber of the first pump set (100) are co-shafted, that is, the rotors in the at least two vacuum chambers of the first pump set (100) are installed at the same first driving shaft;

a second pump set (200) including at least one vacuum chamber which includes at least one rotor and a second driving shaft; and wherein an outlet (301) of the second pump set (200) is connected to an inlet (202) of one vacuum chamber of the first pump set (100) through an air tube (500);

wherein the first pump set (100) includes a first vacuum chamber (1) and a second vacuum chamber (2); the second pump set (200) includes a third vacuum chamber (3); and wherein air is input from a vacuum pump suction (5) of the first vacuum chamber (1) and then to the third vacuum chamber (3) and the second vacuum chamber (2) sequentially; finally, air is drained out from a vacuum pump outlet (6) of the second pump set (200).

2. The multistage pump assembly with at least one co-used shaft as claimed in claim 1, wherein the second pump set includes at least two vacuum chambers, each of the vacuum chamber of the second pump set being installed with at least one rotor and a second driving shaft, the rotor of the second pump set being installed to the second driving shaft in the same vacuum chamber of the second pump set; the second driving shafts in all the vacuum chambers of the second pump set are co-shafted, that is, the rotors in the at least two vacuum chambers of the second pump set are installed at the same second driving shaft.

3. The multistage pump assembly with at least one co-used shaft as claimed in claim 1, wherein the first driving shafts of the first pump set are formed by a first separated driving shaft and a second separated driving shaft which are connected by a connector and are separated with a distance so as to prevent expansion from heating; and the first separated driving shaft is installed to the first vacuum chamber of the at least two vacuum chambers in the first pump set; and the second separated driving shaft is installed to the second vacuum chamber of at least two of the at least one vacuum chambers in the first pump set.

4. The multistage pump assembly with at least one co-used shaft as claimed in claim 3, wherein the first driving shafts of the first pump set further comprising a third separated driving shaft which is connected to one end of the second separated driving shaft, and the end is far away from another end of the second separated driving shaft which is connected to the first separated driving shaft; the second separated driving shaft and the third separated driving shaft are connected through another connector.

5. The multistage pump assembly with at least one co-used shaft as claimed in claim 4, wherein the third separated driving shaft is connected to a spindle of a driving motor.

6. The multistage pump assembly with at least one co-used shaft as claimed in claim 3, wherein the first vacuum chamber further includes a first driven shaft which is connected with a first gear; and the first separated driving shaft is connected to a second gear; the first gear is engaged with the second gear.

7. The multistage pump assembly with at least one co-used shaft as claimed in claim 3, wherein the second vacuum chamber further includes a second driven shaft which is connected with a third gear; and the second separated driving shaft is connected to a fourth gear; the third gear is engaged with the fourth gear.

8. The multistage pump assembly with at least one co-used shaft as claimed in claim 1, wherein the driving shafts in all the vacuum chambers of the same pump set are coaxial.

9. The multistage pump assembly with at least one co-used shaft as claimed in claim 1, wherein each of the first and second pump set is selected from one of a multistage root pump set, screw rod form vacuum pump set and multistage claw form vacuum pump set.

10. The multistage pump assembly with at least one co-used shaft as claimed in claim 1, wherein not the driving shafts in all the vacuum chambers of the same pump set are co-shafted, but the driving shafts in some of the vacuum chambers of the same pump set are coaxial.

* * * * *